United States Patent [19]

Friedman et al.

[11] 4,146,057

[45] Mar. 27, 1979

[54] THERMAL BUFFER SYSTEM

[75] Inventors: Joseph Friedman, Encino; Jerome M. Friefeld, Agoura, both of Calif.

[73] Assignee: Rockwell International Corporation, El Segundo, Calif.

[21] Appl. No.: 849,045

[22] Filed: Nov. 7, 1977

[51] Int. Cl.[2] ..... F03G 7/02; F01K 17/00; F01K 23/02; F24H 7/02

[52] U.S. Cl. ..... 60/648; 60/641; 60/655; 60/659; 122/33; 126/400; 165/1; 165/104 S

[58] Field of Search ..... 60/641, 648, 655, 659, 60/692; 122/33; 126/400; 165/1, 104 S

[56] References Cited

U.S. PATENT DOCUMENTS 4,008,758 2/1977 Chubb ..... 126/400 X 4,055,948 11/1977 Krauss et al. ..... 60/641

*Primary Examiner*—Gerald A. Michalsky

*Attorney, Agent, or Firm*—L. Lee Humphries; Robert M. Sperry

[57] ABSTRACT

A quantity of aluminum is in heat exchange contact with a potassium loop and a steam/water loop. The potassium loop includes a solar energy collector and the solar-heated potassium melts the aluminum to store thermal energy as latent heat of fusion. The steam/water loop extracts steam at 1,000° F. as long as at least some of the aluminum is in the molten state. The steam/water loop includes a steam power turbogenerator unit as user; the quantity of aluminum should suffice to yield, upon resolidification, sufficient heat to satisfy the energy demand of the unit during night time.

10 Claims, 4 Drawing Figures

FIG. 1
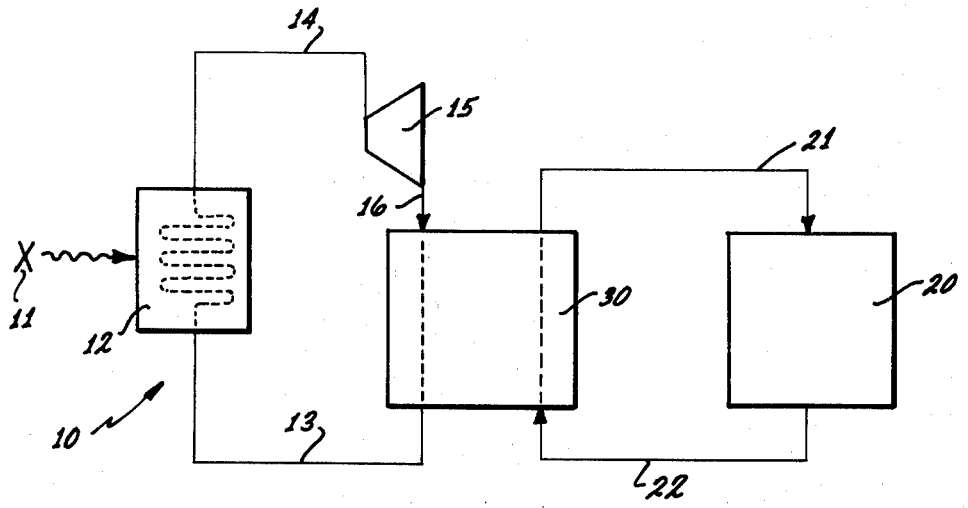
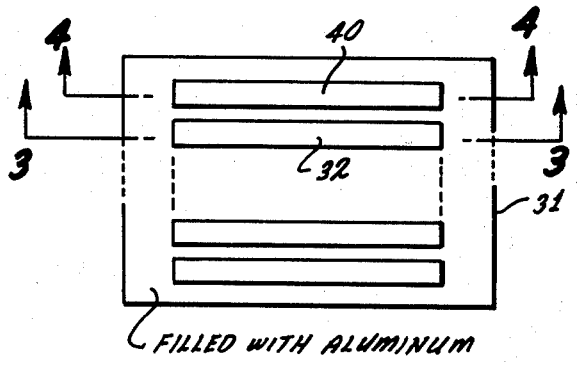
FIG. 2
FIG. 3
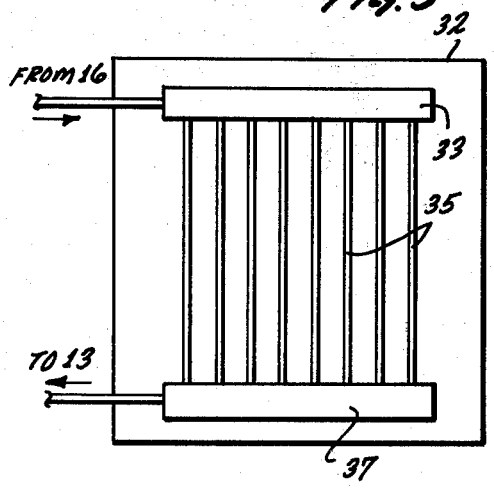
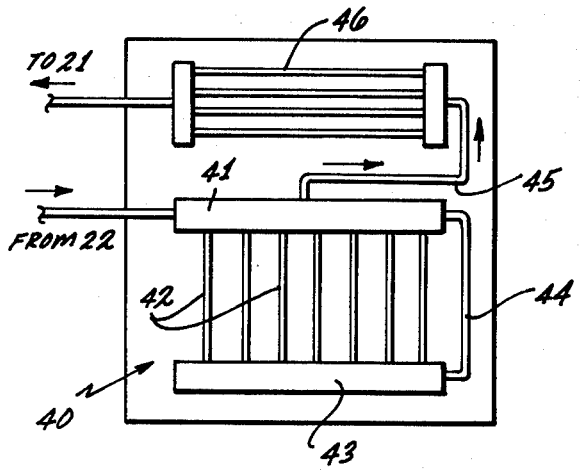
FIG. 4

THERMAL BUFFER SYSTEM

BACKGROUND OF THE INVENTION

The present invention relates to the storage of thermal energy for the purpose of buffering energy in between asynchronously operating supply and demand systems for such heat.

A typical asynchronously operating supply and demand system is any system that requires power on a constant or a particularly variable basis during, e.g. twenty-four hours of a day, while the prime source is to be solar energy. The night time demand has to be buffered. Other asynchronous systems are those in which the thermal energy can be developed at a constant rate, but the demand fluctuates, possibly within wide limits. In all such systems in which the demand variations cannot be taken up by supply variations, or in which inherent supply variations may create temporary shortages, a buffer system is required in which energy is temporarily stored to be available whenever needed. It is apparent that the storage should not lead to any significant loss in the energy supplied. A significant loss occurs, for example, if the energy is repeatedly converted. Thus, if the prime source furnishes energy in the form of heat, the storage should involve storing heat directly and in a manner in which the buffering makes the energy available also as heat. Moreover, the conditions of heat storage and extraction from the buffer should take into consideration that the end user may require suppliance of the heat under particular temperature conditions. For example, steam power systems operate best at high temperatures; they pose, however, a practical limit which is about 1,000° F. Thus, the buffer should furnish heat which raises the temperature of the steam to 1,000° F. To our knowledge, an efficient heat buffer which can, in fact, furnish steam at that temperature is not known at this time.

Utilization of phase changes, and particularly utilization of the latent heat of fusion as a "buffer," for establishing particular temperature conditions, is, of course, well known, and goes back to prehistoric times when men learned to take advantage of the constant temperature of melting ice. Since then, the latent heat of fusion has been used in other instances for buffering heat transfer. In spite of the fact, therefore, that the latent heat of fusion is a well known phenomenon for buffering thermal conditions and heat flows, a suitable buffering system, for example, for a solarenergy-steam power system, is not known.

DESCRIPTION OF THE INVENTION

It is an object of the present invention to provide a new method and system for buffering thermal energy as between asynchronously operating supply and demand; specifically, but not exclusively, the prime source is to be solar radiation.

It is another object of the present invention to provide a new method and system for buffering thermal energy for use in a steam generating system.

The invention is based on the recognition of the fact that, no one hand, steam power system should draw on an energy source that supplies its heat at a temperature well in excess of 1,000° F. Moreover, solar energy collectors to be efficient should operate at a temperature also well in excess of that temperature. Therefore, heat storage should operate in temperature ranges well in excess of 1,000° F.

In accordance with the preferred embodiment of the invention, it is suggested to use aluminum as buffer medium and to rely on the latent heat of fusion of aluminum for heat storage. The input circuit or input loop for the aluminum buffer includes the prime source of thermal energy, e.g. a solar radiation absorber for heating a working fluid in the loop to as high a temperature as material compatibility and structural considerations permit. The working fluid looses as much energy to the aluminum as is required to drop to a temperature close to the melting point of aluminium, so that the aluminum melts gradually. The output circuit or output loop for the buffer includes a steam power system, whereby water is heated by the heated (liquefied) aluminum to a temperature of about 1,000° F. This is readily possible because the melting point of aluminum is 1,220° F., so that the aluminum serves indeed as a constant temperature heat supply for as long as (and even longer to some extent) some of the aluminum is still molten. On the other hand, the melting point of aluminum is well below those temperatures at which one cal still operate the above mentioned input loop bearing in mind limitations set by the structural materials. The input loop is preferably a potassium vapor/liquid which operates at temperatures well above the melting point of aluminum, so that an adequate temperature gradient exists also here, from the input loop into the aluminum. This primary or input loop may include a turbine to extract a small amount of energy from the prime source.

DESCRIPTION OF THE DRAWINGS

While the specification concludes with claims particularly point out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a block diagram of a system in accordance with the preferred embodiment;

FIG. 2 is a schematic top and section view into a buffer used in the system of FIG. 1;

FIG. 3 is a schematic view of a section taken along lines 3—3 in FIG. 2; and FIG. 4 is a schematic view of a section taken along lines 4—4 in FIG. 2.

Proceeding now to the detailed description of the drawings, FIG. 1 illustrates the basic system which includes an energy source and absorbing section 10, a user section 20, and a buffer and intermediate storage secton 30. The energy section 10 includes a primary heat source 11 which in the preferred embodiment is the sun and its radiation, and as far as equipment is concerned, includes focussing or concentrating reflectors and solar ray collecting equipment to be absorbed by the device 12 for immediate conversion of radiant energy into usable thermal energy.

Alternatively, the heat source 11 may be a fossil fueled burner, a nuclear reactor or the like. Generally speaking, device 12 is of any known construction that develops and gathers thermal energy at as high a temperature as is permissible, and in a sufficiently larger quantity to serve as a power source. In view of the fact that the primary source of energy is to be the sum as per the preferred embodiment, the heat source 11 can also be defined as one that yields thermal energy only intermittently. That supply of energy runs asynchronously to the demand to be made, if the energy is to be used to power, e.g. a commercial electrical power system (public utility).

Device 12 is an absorber of thermal energy and includes a heat exchanger for heating, e.g. potassium. Liquid potassium enters the device 12 through a return loop or branch 13, and is vaporized as well as superheated in the device 12, which could also be termed a boiler and superheater for potassium. Potassium is a well known high temperature heat exchange working fluid having well established advantages.

A discharge and output loop 14 receives superheated potassium at a temperature of about 1,550° F. This temperature does not have any direct operational significance. Rather, it is a practical limit for structural material of which the device 12 is composed.

A potassium vapor turbine 15 is the first and immediate user of the absorbed thermal energy and may pertain to a topping cycle. This turbine is, therefore, diposed in the high temperature branch of the potassium loop. An output path 16 of the turbine receives saturated potassium vapor at 1,400° F. That path 16 constitutes the feed path for the thermal input circuit for the storage section 30.

The storage or buffer section 30 is basically a ceramic container (or several containers) filled with aluminum. The storage section includes two different sets of heat exchangers both of them being coupled to the aluminum. One set of the heat exchangers is included in the potassium loop; this set of heat exchangers liquefies the potassium, yielding a significant amount of heat in the process of melting the surrounding aluminum. The liquid potassium leaves buffer 30 via the return branch 13 of the potassium loop. The potassium in loop branch 13 has a temperature of about 1,250° F., i.e. it is just slightly warmer than the melting point of aluminum.

The second circuit or loop which traverses buffer section 30, constitutes the power and energy output loop through which thermal energy is extracted therefrom. It is a steam/water loop whose steam portion and branch 21 feeds a conventional steam power generation system included in the user section 20. That section may also include an electric generator. The user aspects of the steam is not of specific importance, except that the power requirements are expected to occur asynchronously to the supply, e.g. power is also needed at night time and/or peak demands may not at all occur with any periods of maximum power development by the source 11.

The superheated steam leaves the buffer 30 at about 1,000° F. which is the most desirable temperature for a steam powered system. The water (under pressure) is returned to the buffer 30 as subcooled water, and at about 400° F. Reference numeral 22 refers to the return branch 22 for this steam/water loop.

Turning now to the particulars of the storage section 30, it includes a ceramic container 31 filled, as stated, with aluminum, but containing also alternating or interdigitized sets of heat exchangers 32 and 40. The heat exchangers 32 pertain to the first or input loop for thermal energy, and each includes a manifold type portion 33 to which is connected the feeder path 16. Actually, there may be provided another manifold to which connect all the internal manifolds 33 of the several heat exchangers 32. The duct 16 leads to that additional distributing manifold (not shown). A plurality of heat exchange tubes 35 run from the manifold 33 down to a potassium collector 37 which, in turn, is connected to the potassium return path 13. The aluminum level in container 31 may not reach the level of manifold 33 to avoid premature cooling of the potassium vapor and to ensure more or less uniform participation of all tubes 35 in the heat exchange process.

The tubes or ducts 35 are made of silicon carbide or similarly suitable ceramic material and provide for heat exchange between the potassium vapor passing through and the aluminum surrounding the tubes. Accordingly, the aluminum begins to melt and stores the received thermal energy as latent energy of fusion. Since aluminum has a rather high thermal conductivity, an efficient heat transfer continues even after melting of the aluminum in the immediate vicinity of the tubes 35. The melting fronts progress laterally and in downward direction. As long as not all aluminum is molten, the potassium will indeed leave the heat exchangers at a temperature not much in excess of the melting point of aluminum.

The temperature of the aluminum near or right at the upper portions of the ducts 35 will, of course, be higher whenever the potassium loop is shut down (e.g. at night time). Hardly any heat exchange takes place at the tubes 35 in such a situation, and their vicinity will remain the points of highest temperature in the container.

The heat exchangers 40 are provided in the output or steam/water loop. They each have two portions, a lower, boiler portion, and an upper, superheating portion. The boiler portion has a boiler and steam/water separating chamber (drum) 41, into which is fed water 400° F. from the return path 22 of that loop. Heat exchange tubes 42 lead from the boiler water chamber 43 to the separating chamber 41. A water recirculation duct 44 connects the chamber 43 to the upper part of boiler and separating chamber 41. A duct 45 collects steam from chamber 41 and feeds it to the superheater 46 from which superheated steam is fed to the steam duct 21. The steam receives a temperature of about 1,000° F. due to heat exchange between the molten aluminum and the water/steam.

It can readily be seen that, depending on the capacity and dimensions of the storage section 30, the development of steam from the water fed to the boiler and separator 41, is to a considerable extent independent from any concurring and/or preceding supply of thermal energy to the buffer. As long as some of the aluminum is still molten, steam can be developed at the desired temperature. Whenever heat is not fed to the buffer, the solidification zones, being the boundaries between molten and solid aluminum, recede slowly from the heat exchangers 40, but as long as any molten aluminum is present in the vicinity of the tubes 42, steam will still be developed. Moreover, the superheater 46 extracts comparatively little thermal energy from the aluminum and the temperature gradient in the vicinity of the superheater is comparatively small. Hence, the receding of the solidification boundary from the superheater and the resulting flattening of the temperature gradient thereat have little effect on the heat transfer so that the steam leaves the superheater and the store 30 with hardly any temperature variations. It should be noted that the rate of energy extraction from the buffer can be controlled by controlling the number of heat exchangers 46 participating in the steam/water loop in any instant. This way, one obtains a more or less constant throughput of water through each boiler section.

As far as the heat transfer to the buffer is concerned, heat can still be stored as long as some of the aluminum is still solid. Also, as stated, heat can be extracted at least as long as aluminum is still molten. Considering these conditions as requisite limits, the system does, in fact, operate on the basis of stable thermal conditions so that irrespective of supply changes, the steam temperature remains a constant 1,000° F. until all aluminum has been resolidified, while melting of all of the aluminum signals termination of further storage. The potassium cycle has to be shut down also when the source 11 interrupts its providing of absorbable energy.

It is significant that the operating temperature of the storage system, namely the melting point of aluminum, has a value in about the middle between the maximum temperatures of the two heat exchange fluids (potassium and steam) as they respectively enter and leave the buffer 30. This ensures comparable heat transfer conditions for both sets of exchangers.

By way of example, a power system that is able to absorb 2,000 megawatt hours in thermal energy requires about 250,000 gallons of aluminum. That amount of aluminum is capable of furnishing energy to produce 100 megawatt of electrical energy for about six hours.

The invention is not limited to the embodiments described above but all changes and modifications thereof not constituting departures from the spirit and scope of the invention are intended to be included.

We claim:

1. An energy storage system for buffering intermittency of and/or asynchronism between energy supply and energy usage, and to be interposed between a source of thermal energy and a steam power system, comprising:

a high temperature fluid loop which includes or is exposed to the source of energy to provide a high temperature fluid and to return such fluid having lost some of its energy to be exposed again to the energy of the source;

a container means containing aluminum, the high temperature loop including a portion in heat exchange contact with the aluminum, the fluid of the high temperature loop as fed to the container means having a temperature well in excess of the melting point of aluminum; and a steam/water loop having a portion in heat exchange contact with the aluminum for heating steam to a high temperature, the steam/water loop including the steam power system and a return path to the container means.

2. An energy storage system as in claim 1, wherein the high temperature fluid loop includes a turbine for extracting energy from that loop without storage.

3. An energy storage system as in claim 1, wherein the high temperature fluid is potassium.

4. A thermal energy store, comprising:

container means holding a quantity of aluminum;

a first heat exchanger in the container means and adapted to be passed through by a high temperature fluid and being in heat exchange contact with the aluminum; and a second heat exchanger in the container means in heat exchange contact with the aluminum, and adapted to be passed through by a second fluid to receive thermal energy from the aluminum including latent heat of fusion during resolidification of the aluminum.

5. A store as in claim 4, there being a plurality of first heat exchangers and a plurality of second heat exchangers, respectively, interdigitized with the first heat exchangers.

6. A store as in claim 4, said second heat exchanger including a boiler for vaporizing the second fluid and a superheater connected to the boiler to receive therefrom vaporized second fluid and to superheat the vaporized second fluid, the boiler and the superheater being in heat exchange contact with the aluminum.

7. A buffering method for temporarily storing thermal energy, comprising the steps of causing a first fluid to absorb thermal energy to assume a temperature in excess of the melting point of aluminum;

transporting the fluid to a store of aluminum to enter into heat exchange relation therewith to obtain gradual melting of the aluminum;

causing a second, relatively cool fluid to enter into heat exchange with the aluminum to extract therefrom thermal energy, including extraction during continued resolidification of molten aluminum.

8. A method of powering a steam power system, comprising the steps of causing water to enter into heat exchange relation with molten aluminum to obtain superheated steam during resolidification of the aluminum.

9. A method of storing solar energy comprising the steps of causing solar energy to be absorbed by a working fluid, and causing the working fluid to melt aluminum.

10. In a solar radiation utilization system which includes means for concentrating and absorbing solar radiation for heating a working fluid, the improvement of a thermal energy source being comprised of a contained amount of aluminum and a heat exchanger in the aluminum and connected to be passed through by the working fluid to obtain gradual melting of the aluminum.

* * * * *